US009765581B2

(12) United States Patent
Smith et al.

(10) Patent No.: US 9,765,581 B2
(45) Date of Patent: Sep. 19, 2017

(54) TUBULAR GRIPPING APPARATUS WITH MOVABLE BOWL

(71) Applicant: Frank's International, Inc., Houston, TX (US)

(72) Inventors: Logan Essex Smith, Youngsville, LA (US); Robert L. Thibodeaux, Lafayette, LA (US); Jeremy Richard Angelle, Youngsville, LA (US)

(73) Assignee: Frank's International, Inc., Houston, TX (US)

( * ) Notice: Subject to any disclaimer, the term of this patent is extended or adjusted under 35 U.S.C. 154(b) by 400 days.

(21) Appl. No.: 14/566,330

(22) Filed: Dec. 10, 2014

(65) Prior Publication Data

US 2015/0159445 A1 Jun. 11, 2015

Related U.S. Application Data

(60) Provisional application No. 61/914,361, filed on Dec. 10, 2013.

(51) Int. Cl.
*E21B 19/10* (2006.01)
*E21B 19/07* (2006.01)
*E21B 19/24* (2006.01)

(52) U.S. Cl.
CPC ..... *E21B 19/10* (2013.01); *E21B 19/07* (2013.01); *E21B 19/24* (2013.01)

(58) Field of Classification Search
CPC ..... E21B 19/07; E21B 19/10; E21B 19/24
See application file for complete search history.

(56) References Cited

U.S. PATENT DOCUMENTS

| | | | | |
|---|---|---|---|---|
| 2,410,589 | A * | 11/1946 | Segelhorst | E21B 19/10 166/75.14 |
| 2,589,159 | A | 3/1952 | Stone | |
| 2,700,201 | A * | 1/1955 | Bannister | E21B 19/10 188/67 |
| 3,472,535 | A * | 10/1969 | Kinley | E21B 19/10 188/67 |
| 4,449,596 | A | 5/1984 | Boyadjieff | |
| 6,651,737 | B2 | 11/2003 | Bouligny et al. | |
| 2005/0077039 | A1 | 4/2005 | Shahin et al. | |
| 2006/0254866 | A1 | 11/2006 | Shahin | |
| 2009/0252589 | A1 | 10/2009 | Sonneveld et al. | |
| 2012/0061101 | A1* | 3/2012 | Angelle | E21B 19/07 166/382 |
| 2013/0126189 | A1 | 5/2013 | Angelle et al. | |

OTHER PUBLICATIONS

International Search Report and Written Opinion issued in corresponding application No. PCT/US2014/069592, dated Mar. 25, 2015, 10 pgs.

* cited by examiner

*Primary Examiner* — George Gray
(74) *Attorney, Agent, or Firm* — Chamberlain Hrdlicka

(57) ABSTRACT

A tubular gripping apparatus includes a main bowl including a bore formed therethrough about an axis, and a movable bowl movably receivable within the main bowl. The movable bowl includes a bore formed therethrough about an axis with a tapered surface extending along the bore of the movable bowl, in which the tubular gripping apparatus further includes a plurality of slip assemblies movably receivable within the movable bowl, the plurality of slip assemblies configured to engage an outer surface of a tubular member.

22 Claims, 11 Drawing Sheets

TUBULAR GRIPPING APPARATUS WITH MOVABLE BOWL

CROSS-REFERENCE TO RELATED APPLICATIONS

The present application claims benefit to U.S. Provisional Patent Application No. 61/914,361, filed on Dec. 10, 2013. This priority application is hereby incorporated herein by reference in its entirety.

BACKGROUND

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a male "pin" member of a first tubular member is configured to threadably engage a corresponding female "box" member of a second tubular member. Alternatively, a casing string may be made-up of a series of male-male ended casing joints coupled together by female-female couplers. The process by which the threaded connections are assembled is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Referring to FIG. 1, a perspective view is shown of one embodiment of a drilling rig 101 used to run one or more tubular members 111, such as when running casing and/or drill pipe downhole into a wellbore 113. As shown, the drilling rig 101 includes a frame structure known as a "derrick" 102 from which a traveling block 103 (which may include a top drive) suspends a lifting apparatus 105. The lifting apparatus 105 may include an elevator and/or a tubular (e.g., casing) running tool connected to the quill of a top drive. Further, a gripping apparatus 107, such as a slip assembly or "spider", may be included at the rig floor of the drilling rig 101 and may be used to manipulate (e.g., raise, lower, rotate, hold, etc.) a tubular member 111. The traveling block 103 is a device that is suspended from at or near the top of the derrick 102, in which the traveling block 103 may move up-and-down (i.e., vertically as depicted) to raise and/or lower the tubular member 111. The traveling block 103 may be a simple "pulley-style" block and may have a hook from which objects below (e.g., lifting apparatus 105 and/or top drive) may be suspended. The drilling rig 101 can be a land or offshore rig (e.g., drill ship) without departing from the spirit of the invention.

Additionally, the lifting apparatus 105 may be coupled below the traveling block 103 (and/or a top drive if present) to selectively grab or release a tubular member 111 as the tubular member 111 is to be raised and/or lowered within and from the derrick 102. As such, the top drive may include one or more guiding rails and/or a track disposed adjacent to the top drive, in which the guiding rails or track may be used to support and guide the top drive as the top drive is raised and/or lowered within the derrick. An example of a top drive is disclosed within U.S. Pat. No. 4,449,596, filed on Aug. 3, 1982, and entitled "Drilling of Wells with Top Drive Unit," which is incorporated herein by reference.

Typically, a lifting apparatus 105 includes movable gripping members (e.g., slip assemblies) attached thereto and movable between a retracted (e.g., disengaged) position and an engaged position. In the engaged position, the lifting apparatus 105 supports the tubular member 111 such the tubular member 111 may be lifted and/or lowered, and rotated if so equipped, e.g., by using a lifting apparatus that is a tubular (e.g., casing) running tool connected to the quill of the top drive. In the retracted position, the lifting apparatus 105 may release the tubular member 111 and move away therefrom to allow the tubular member 111 to be engaged with or removed from the lifting apparatus 105 and/or the gripping apparatus 107. For example, the lifting apparatus 105 may release the tubular member 111 after the tubular member 111 is threadably connected to a tubular string 115 supported by the gripping apparatus 107 (e.g., slip assembly or "spider") at the rig floor at the floor of the drilling rig 101.

Further, in an embodiment in which the drilling rig 101 includes a top drive and a tubular running tool, the tubular member 111 may be supported and gripped by the tubular running tool connected to the quill of the top drive. For example, the tubular running tool may include one or more gripping members that may move radially inward and/or radially outward. In such embodiments, these gripping members of a tubular running tool may move radially outward to grip an internal surface of the tubular member 111, such as with an internal gripping device and/or the gripping members of the tubular running tool may move radially inward to grip an external surface of the tubular member 111, such as with an external gripping device, however so equipped.

As such, the gripping apparatus 107 of the drilling rig 101 may be used to support and suspend the tubular string 115, e.g., by gripping, from the drilling rig 101, e.g., supported by the rig floor 109 or by a rotary table thereof. The gripping apparatus 107 may be disposed within the rig floor 109, such as flush with the rig floor 109, or may extend above the rig floor 109, as shown. As such, the gripping apparatus 107 may be used to suspend the tubular string 115, e.g., while one or more tubular members 111 are connected or disconnected from the tubular string 115.

Referring now to FIGS. 2A and 2B, a gripping device 201 that may be included as the lifting apparatus 105 and/or the gripping apparatus 107 of the drilling rig 101 is shown. As such, the gripping device may be the same or similar to the gripping devices shown and disclosed within U.S. Pat. No. 7,4997,333, filed on Aug. 28, 2007, and entitled "Segmented bottom guide for string elevator assembly," and U.S. Pat. No. 7,992,634, filed on May 23, 2008, and entitled "Adjustable pipe guide for use with an elevator and/or a spider," both of which were incorporated by reference above, or may be any other gripping or supporting device known in the art. For example, in addition or in alternative to a gripping device, a lifting apparatus 105 and/or the gripping apparatus 107 may comprise a supporting device may be used that supports one or more tubular members within a drilling rig, such as supporting a tubular string of tubular members suspended from a drilling rig. An example of a supporting device is disclosed within U.S. Pat. No. 6,651,737, filed on Jan. 24, 2001, and entitled "Collar Load Support system and Method," which is incorporated herein by reference.

The illustrated gripping device 201 includes a bowl 203 with a plurality of slip assemblies 205 movably disposed therein. Specifically, the slip assemblies 205 may be connected to a ring 207, in which the ring 207 may be connected to the bowl 203 through an actuator (e.g., actuator rods) 209. Actuator may be actuated, such as electrically actuated and/or fluidly (e.g., hydraulically) actuated, to move up and/or down with respect to the bowl 203, in which the slip assemblies 205 connected to the ring 207 may correspondingly move up and/or down with respect to the bowl 203.

The illustrated slip assemblies 205 are designed to engage and contact the inner tapered surface of the bowl 203 when moving with respect to the bowl 203. Bowl 203 is shown as a continuous surface but may comprise non-continuous surfaces (e.g., a surface adjacent to the rear of each slip assembly 205). Thus, as the slip assemblies 205 move up or down with respect to the bowl 203, the slip assemblies 205 may travel down along an inner surface of the bowl 203. With this movement, an inner surface (e.g., die) of the slip assemblies 205 will grip a tubular member 211 disposed within the gripping device 201. The slip assemblies 205 may have a gripping surface (e.g., teeth), such as a die, on the inner surface to facilitate the gripping of the tubular member 211. After the tubular member 211 is supported by the gripping device 201, additional tubular members may be connected or disconnected from the tubular member 211.

As shown with respect to FIGS. 2A and 2B, the gripping device 201 may be used to grip tubular members 211 having multiple outer diameters. For example, as shown in FIG. 2A, the slip assemblies 205 may be positioned within the bowl 203 of the gripping device 201 to grip a tubular member 211A having a first diameter D1. As discussed, the slip assemblies 205 may be positioned using the ring 207 that may be vertically moveable, e.g., through the actuator rods 209. FIG. 2B shows gripping device 201, in which the slip assemblies 205 are positioned vertically higher within the bowl 203 with respect to the positioning of the slip assemblies 205 shown in FIG. 2A. As such, this positioning of the slip assemblies 205 in FIG. 2B enables the gripping device 201 to grip another tubular member 211B, in which the tubular member 211B has a second outer diameter D2 larger than the first outer diameter D1 of the tubular member 211A (for example, where D1 and D2 are on a tubular body itself and not a connector portion thereof). Thus, gripping device 201 may grip tubular members 211 having a large range of outer diameters without the need of reconfiguration and/or adding supplemental equipment to the gripping device 201. For example, in one embodiment, the second outer diameter D2 may be at least 145 percent larger (or smaller) than the first outer diameter D1.

A tubular string of tubular members may be heavy, in the magnitude of several hundreds of thousands of pounds. As such, the gripping devices handling these tubular strings, in addition to the drilling rig and other components thereof, must be equipped to handle such weight. Further, the tubular string may have one or more different tubular members or tubular sections, such as including a section within the tubular string having casing, drill pipe, and/or a landing string, in which each of these sections of the tubular string may have different dimensions (internal diameter and/or external diameter). As such, effectively handling tubular members having different dimensions within an oilfield environment remains a priority to increase the efficiency and effectiveness of tubular handling equipment.

BRIEF DESCRIPTION OF THE DRAWINGS

For a detailed description of the preferred embodiments of the invention, reference will now be made to the accompanying drawings in which.

DETAILED DESCRIPTION

Figure 1:
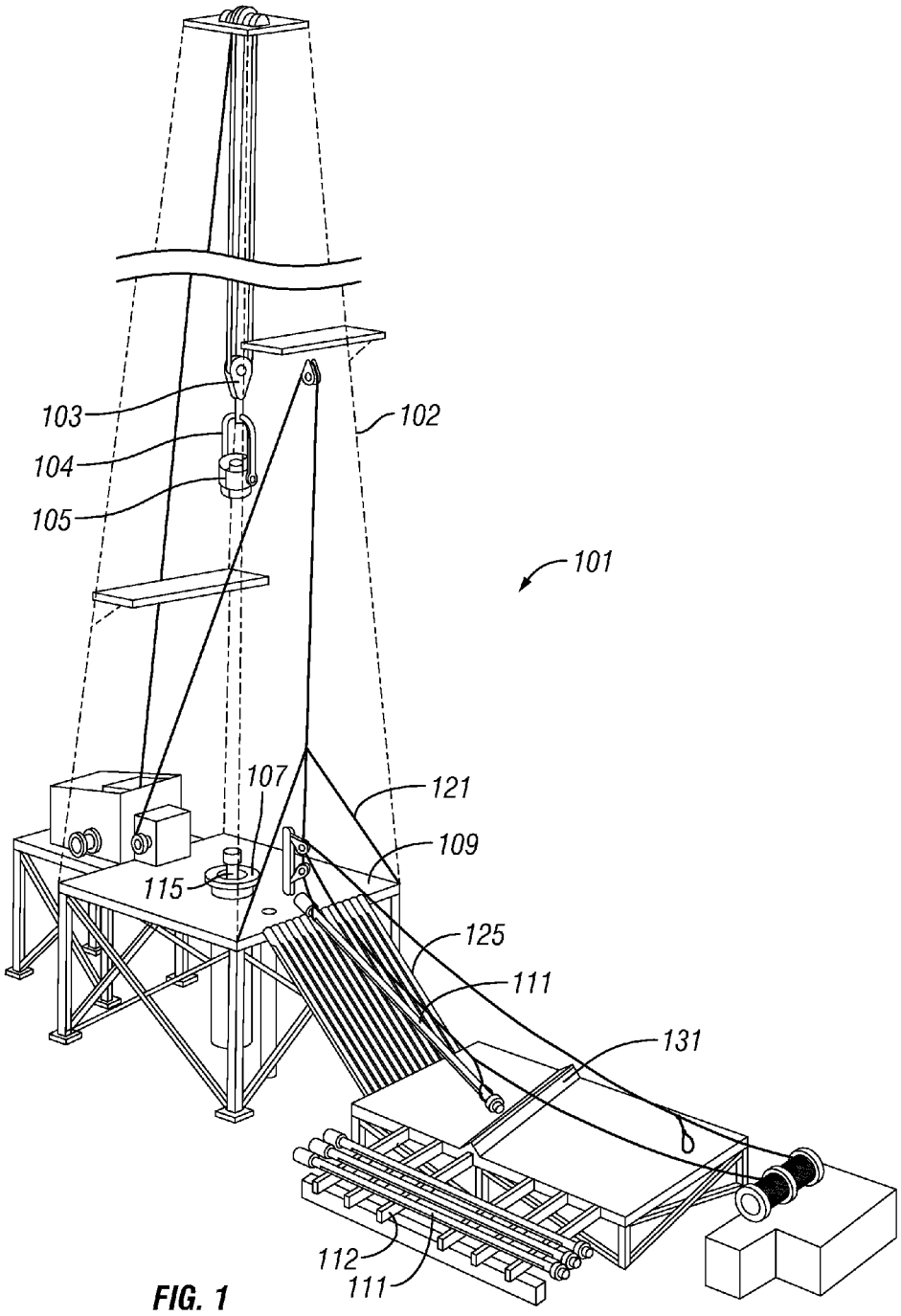
FIG. 1 shows a drilling rig including a tubular gripping apparatus.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct coupling, and the "connect" or "connects" is intended to mean either an indirect or direct connection, unless otherwise denoted. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

In accordance with various aspects disclosed herein, the present disclosure relates to a tubular gripping apparatus that may be used to grip and/or support a tubular member, such as within an oilfield exploration and production operation environment discussed above. The tubular gripping apparatus may include a main bowl with a movable bowl movably received within the main bowl. Further, a plurality of slip assemblies may be movably received within the movable bowl, in which the plurality of slip assemblies may be used to engage an outer surface of a tubular member. The tubular gripping apparatus may be movable between an engaged position, in which the plurality of slip assemblies are engaged with the outer surface of the tubular member, and a disengaged position, in which the plurality of slip assemblies are not engaged and/or in contact with the outer surface of the tubular member.

As such, when moving between the engaged and disengaged positions, the movable bowl may be movable between an upper position and a lower position with respect to the main bowl, in which the movable bowl may be disposed in the lower position when the plurality of slip assemblies are engaged with the outer surface of the tubular member, and the movable bowl may be disposed in the upper position when the plurality of slip assemblies are not engaged and/or in contact with the outer surface of the tubular member. By including a main bowl, a movable bowl, and/or a plurality of slip assemblies, a tubular gripping apparatus in accordance with one or more embodiments of the present disclosure may be able to engage, grip, and support tubular members having a variety of shapes, sizes, and/or dimensions. For example, a tubular gripping apparatus in accordance with one or more embodiments of the present disclosure may be able to engage, grip, and support tubular members having an outer diameter ranging between about 7 inches (about 18 cm) to about 20 inches (about 51 cm) without the need to change any components of the tubular gripping apparatus.

Figure 3A:
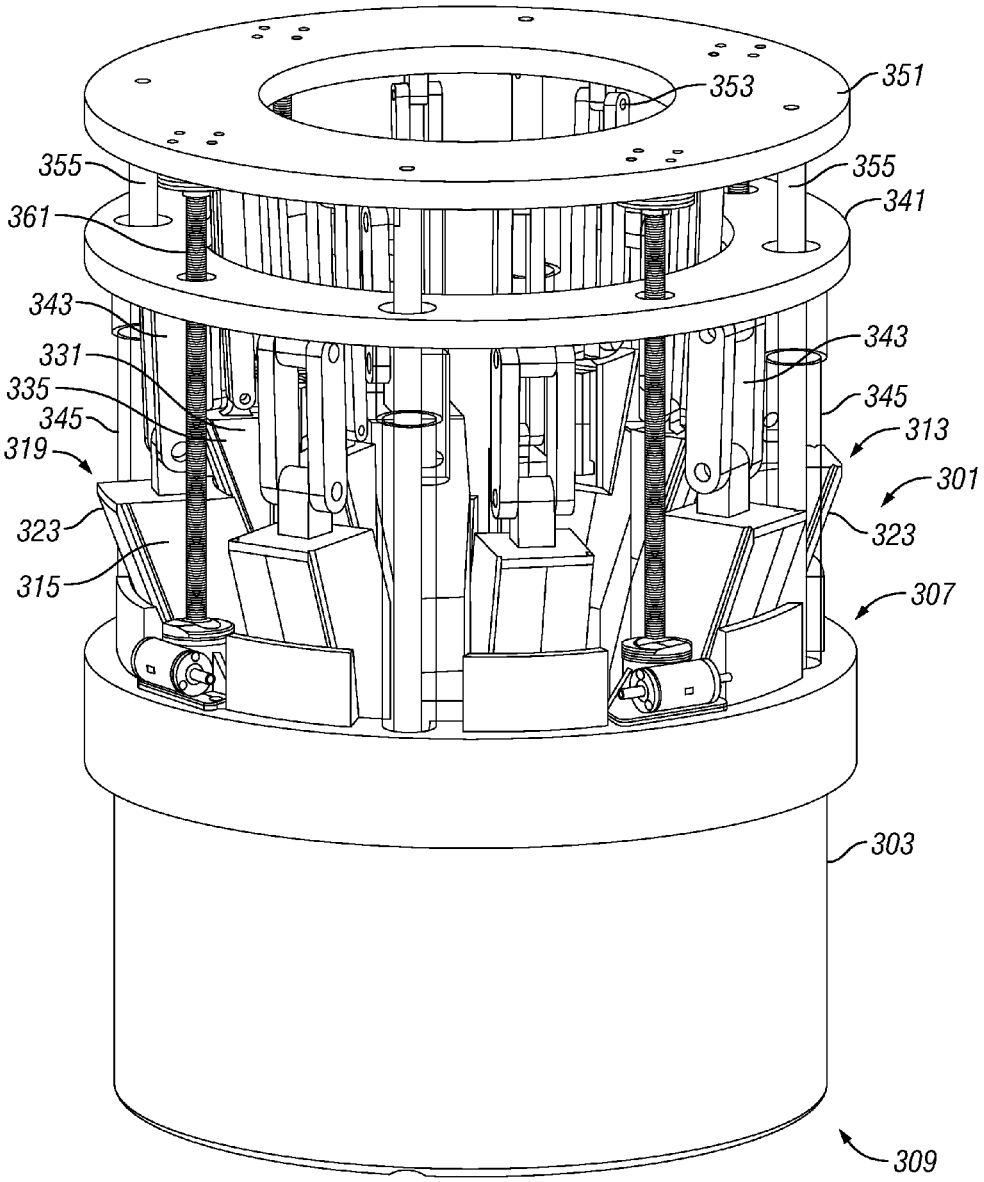
FIGS. 3A and 3B show a tubular gripping apparatus in an upper position in accordance with one or more embodiments of the present disclosure.
Figure 3B:
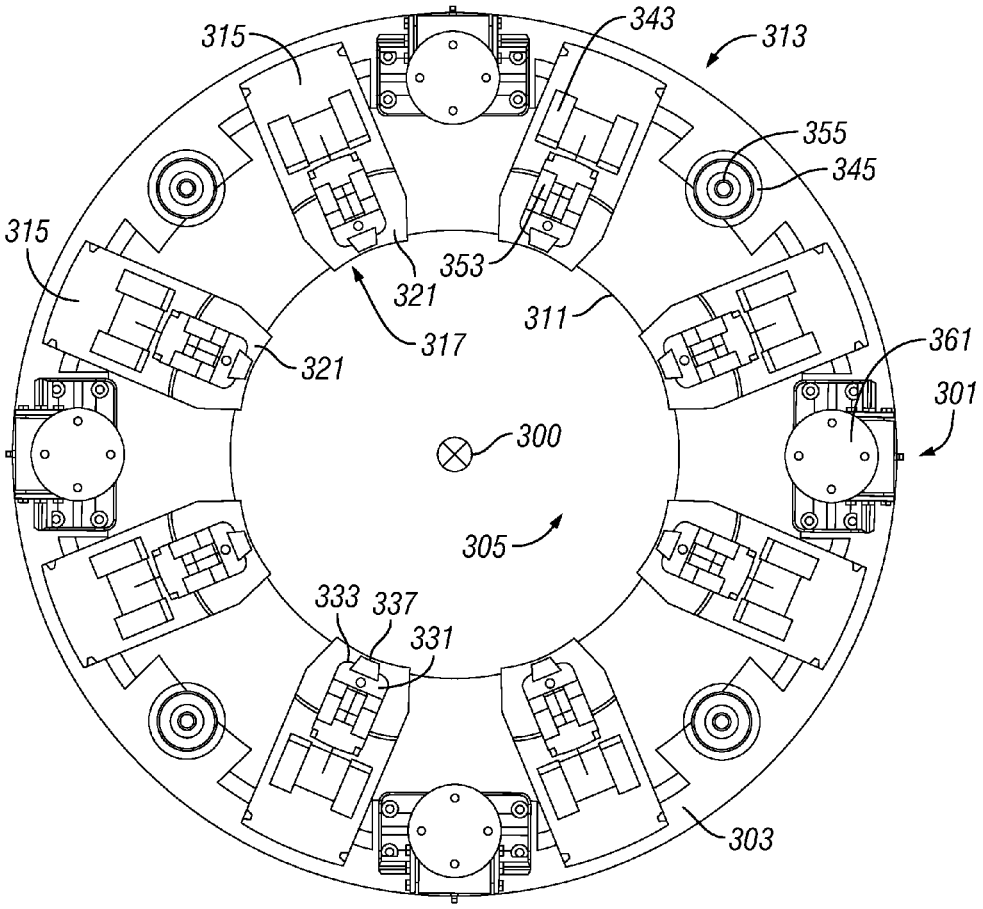
Figure 4A:
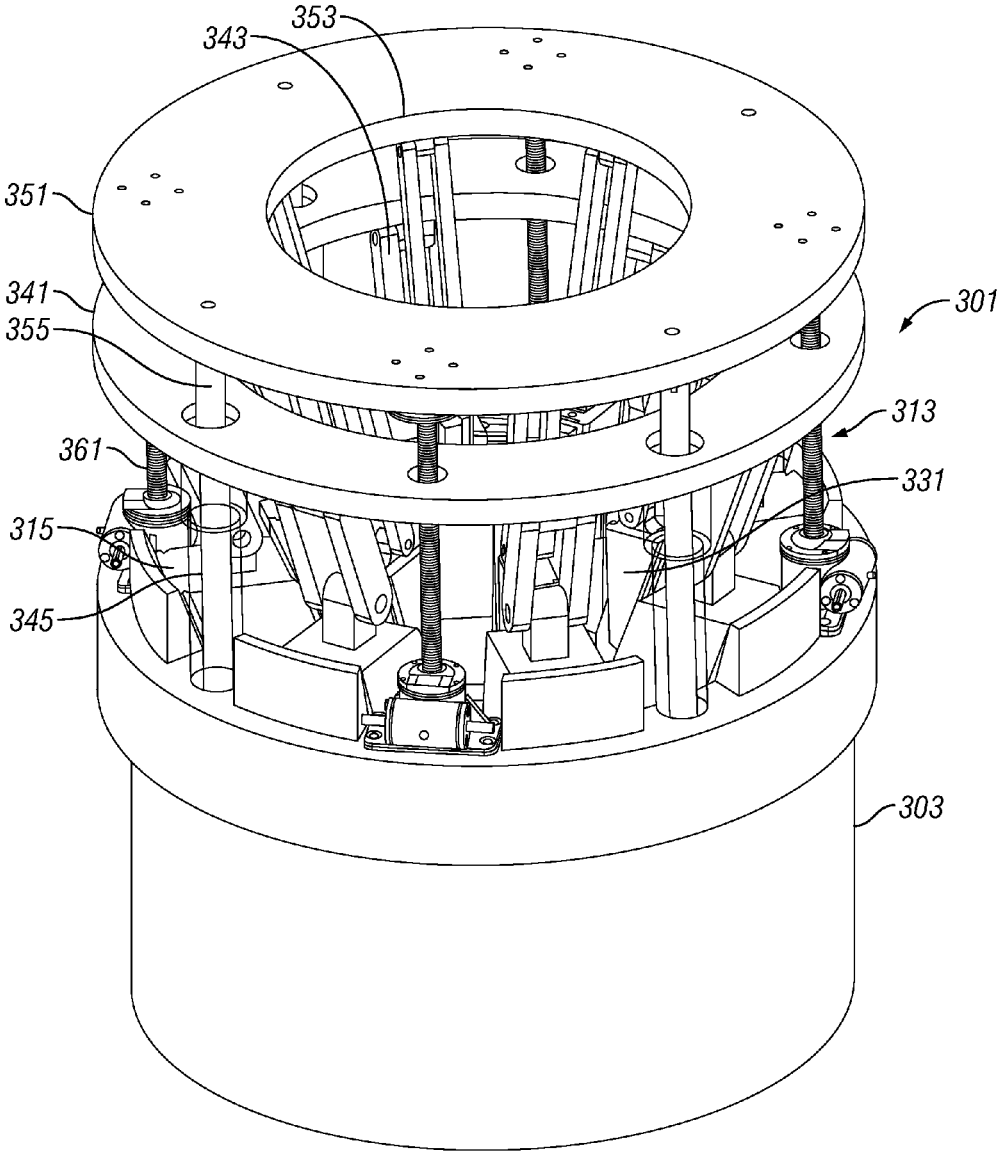
FIGS. 4A and 4B show a tubular gripping apparatus in an intermediate position in accordance with one or more embodiments of the present disclosure.
Figure 4B:
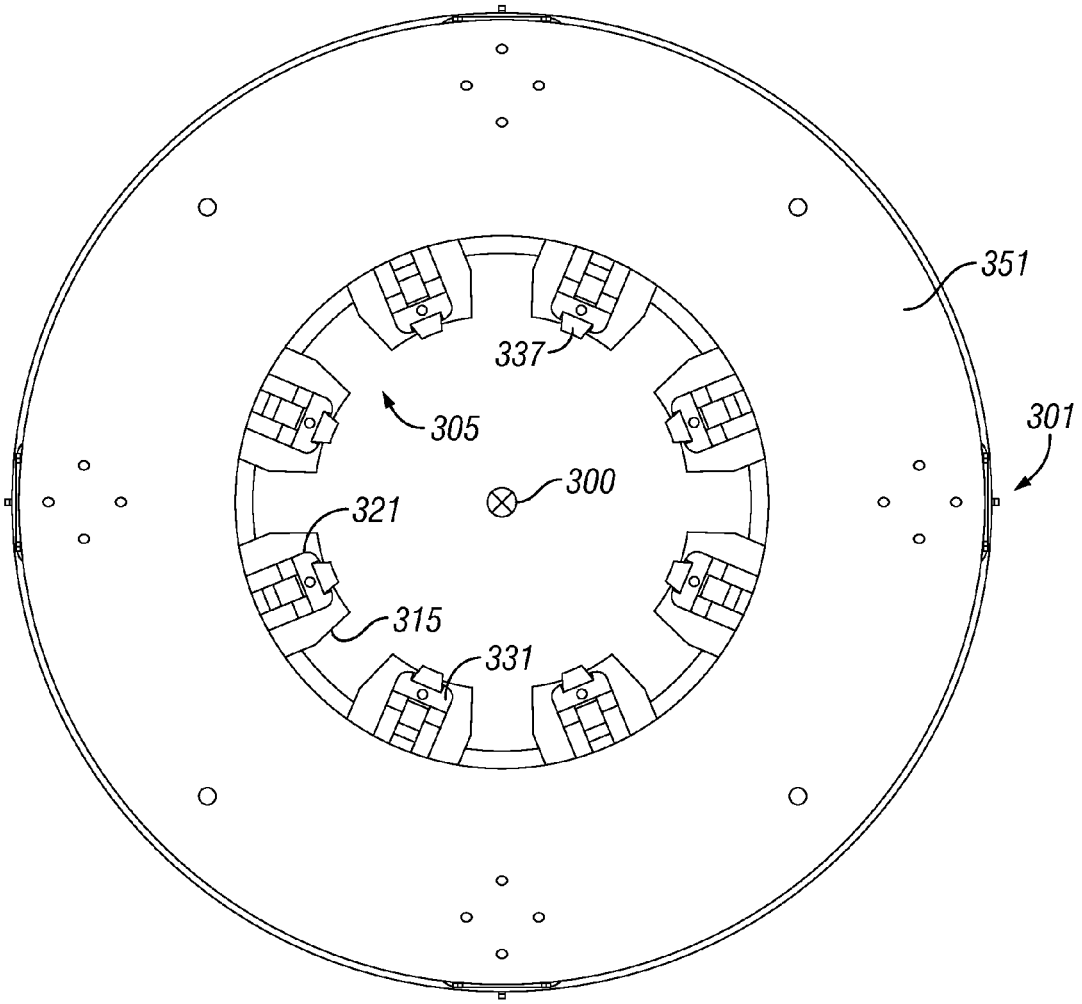
Figure 5A:
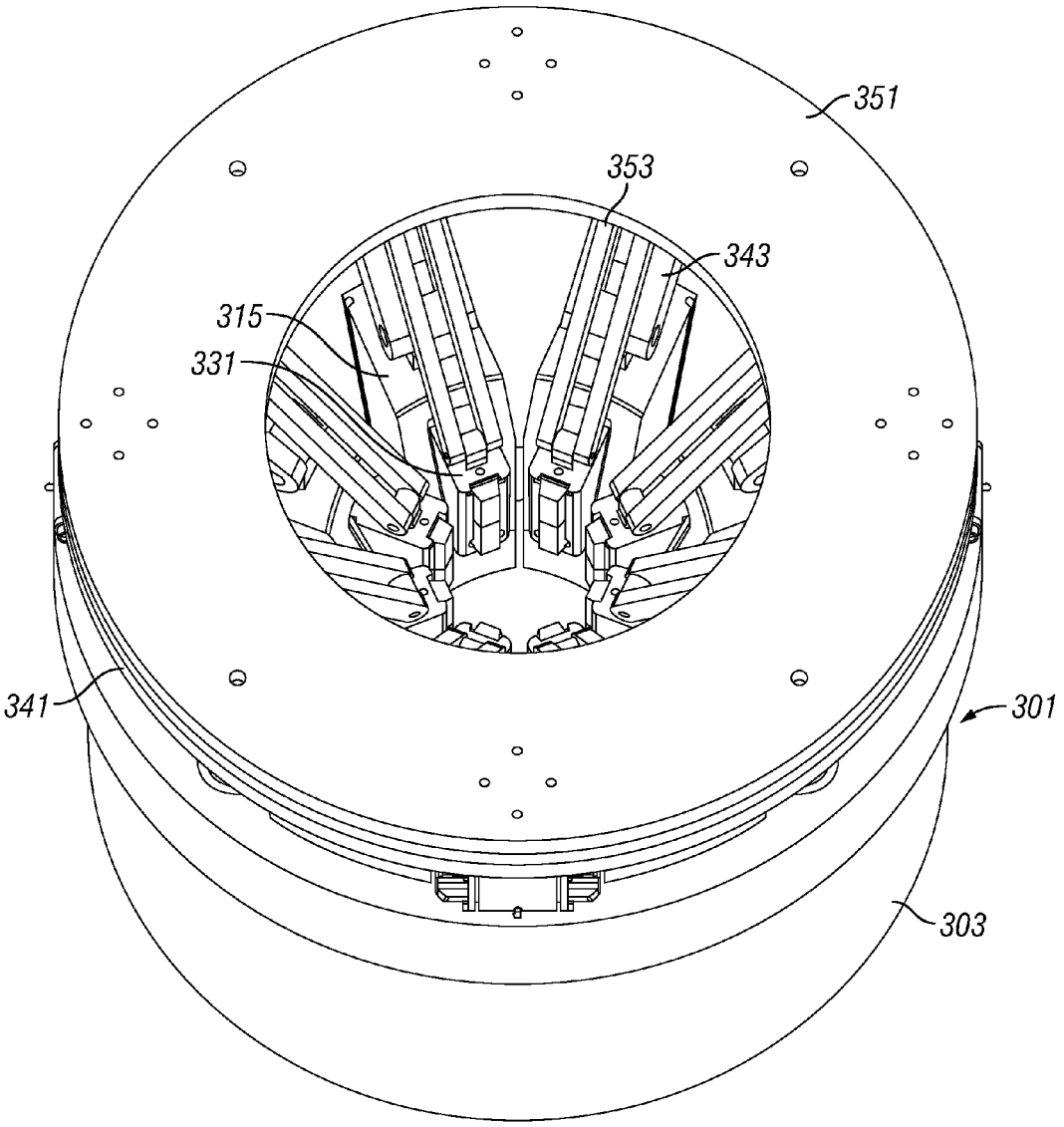
FIGS. 5A and 5B show a tubular gripping apparatus in a lower position in accordance with one or more embodiments of the present disclosure.
Figure 5B:
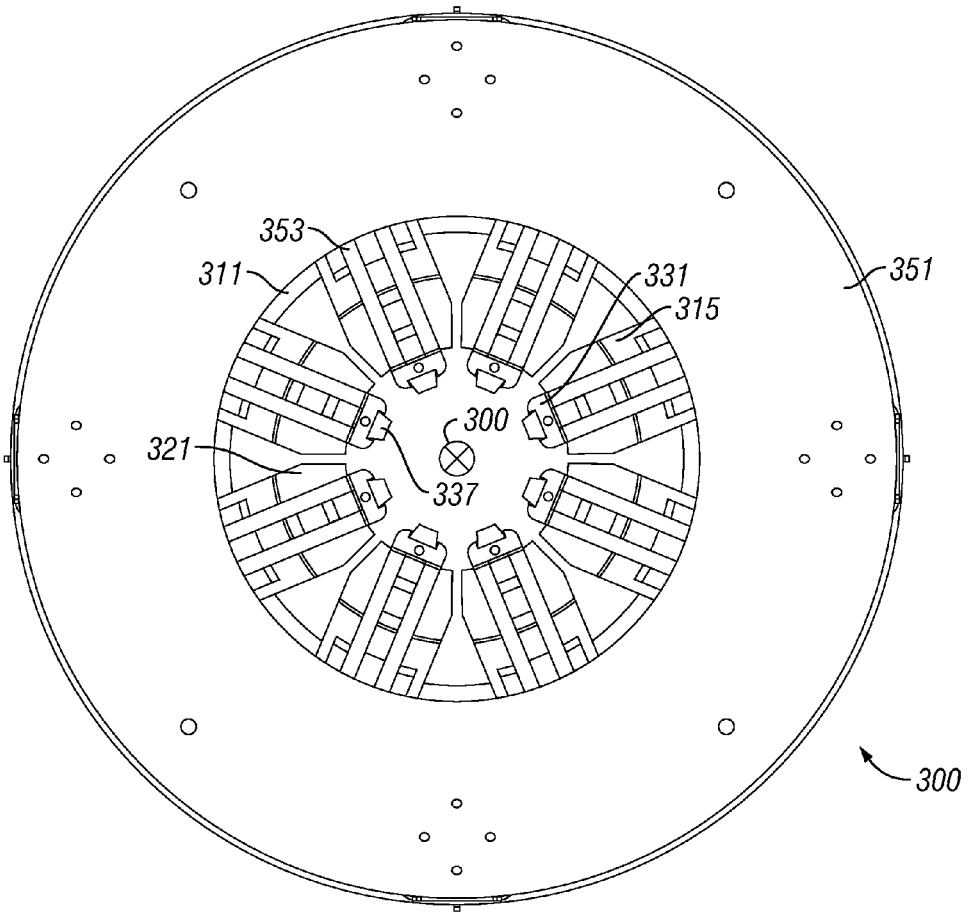

Referring now to FIGS. 3A, 3B, 4A, 4B, 5A, and 5B, multiple views of an apparatus 301 to engage, grip, and/or support a tubular member in accordance with one or more embodiments of the present disclosure are shown. In particular, as discussed above, the apparatus 301 may be movable between an engaged position, when in contact with a tubular member, and a disengaged position, when not in contact with a tubular member. As such, FIGS. 3A and 3B show a perspective view and an above view, respectively, of the apparatus 301 when in an upper position, FIGS. 4A and 4B show a perspective view and an above view, respectively, of the apparatus 301 when in an intermediate position, and FIGS. 5A and 5B show a perspective view and an above view, respectively, of the apparatus 301 when in a lower position.

Depending on the size of the tubular member used with the apparatus 301, the apparatus 301 may engage, grip, and/or support the tubular member at any position shown in FIGS. 3A, 3B, 4A, 4B, 5A, and 5B, in addition to positions not shown. For example, for a tubular member having a larger outer diameter, the apparatus 301 may be closer to the upper position and/or the intermediate position than the lower position when in the engaged position to contact the tubular member. Further, for a tubular member having a smaller outer diameter, the apparatus 301 may be closer to the intermediate position and/or the lower position than the upper position when in the engaged position to contact the tubular member. However, for the sake of simplicity, FIGS. 3A and 3B may refer to when the apparatus 301 is in a disengaged position, and FIGS. 5A and 5B may refer to when the apparatus 301 is in an engaged position.

Figure 2A:
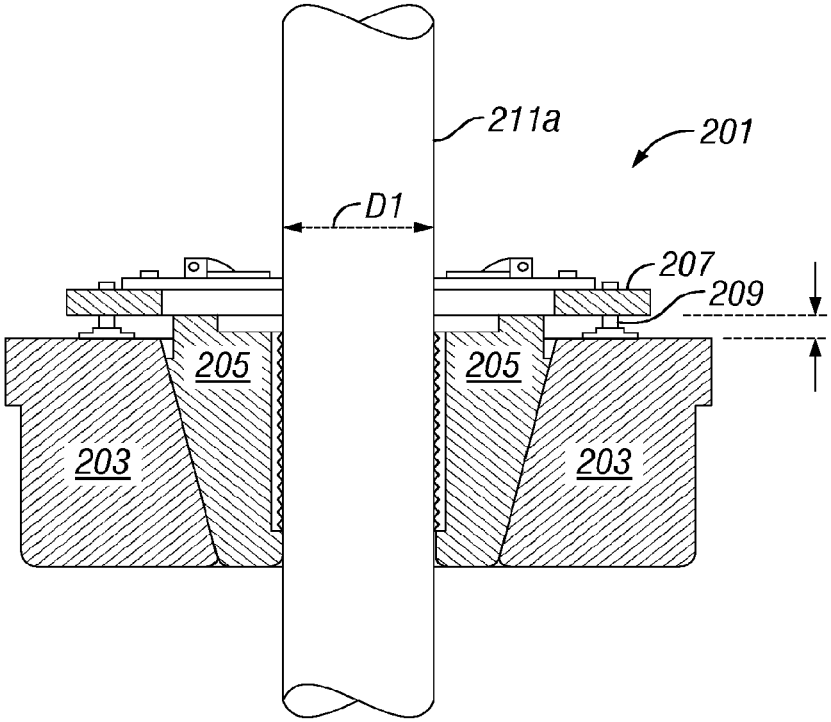
FIG. 2A PRIOR ART
FIGS. 2A and 2B show a tubular gripping apparatus.
Figure 2B:
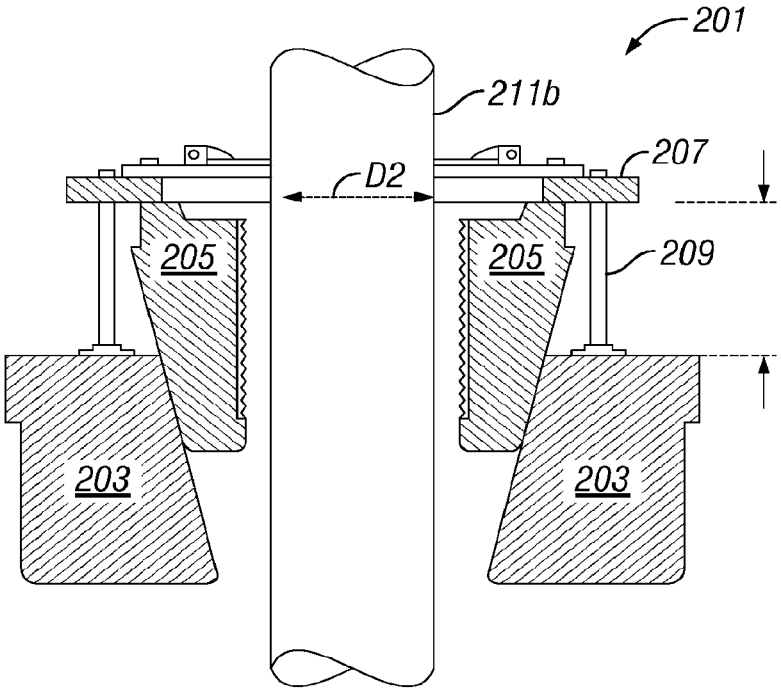
FIG. 2B PRIOR ART

As shown, the illustrated apparatus 301, which may be a lifting apparatus (e.g., 105 in FIG. 1), such as an elevator, a supporting apparatus (e.g., 107 in FIG. 1), a gripping device (e.g., 201 in FIGS. 2A and 2B) and/or any other device or mechanism used to support a tubular member, may include a main bowl 303 defining a bore 305 therein. The bore 305 may be formed about an axis 300 extending (longitudinally) through the apparatus 301. Specifically, the main bowl 303 may be formed such that a top opening 307 of the bore 305 is formed at a top side of the main bowl 303, and a bottom opening 309 of the bore 305 is formed at a bottom side of the main bowl 303. Further, the illustrated main bowl 303 may have an inner surface 311 that extends between the top opening 307 to the bottom opening 309 of the main bowl 303 and may extend circumferentially around the bore 309. Although shown as a single piece monolithic structure, the main bowl 303, in addition to other components of the apparatus 301, may be formed of multiple pieces.

The inner surface 311 of the main bowl 303 may be tapered with respect to the axis 300, such as by having the inner surface 311 skewed at an angle with respect to the axis 300. For example, the main bowl 303 may have a smooth, non-stepped profile, tapered inner surface 311, or at least a portion of the inner surface 311 of the main bowl 303 may have a smooth, non-stepped, tapered profile. As such, the main bowl 303 may be used to enable the apparatus 301 to engage a range of tubular members having different dimensions included and received within the main bowl 303. However, those having ordinary skill in the art will appreciate that the present disclosure is not so limited, as other shapes and profiles, such as a stepped (e.g., rapid advance) profile, may be used for the inner surface of the main bowl without departing from the scope of the present disclosure.

Further, the apparatus 301 may include a movable bowl 313 that may be movably received within the main bowl 303. For example, the movable bowl 313 may be able to move between an upper position, as shown in FIGS. 3A and 3B, and a lower position, as shown in FIGS. 5A and 5B, with respect to the main bowl 303. As shown, in one or more embodiments, the movable bowl 313 may be formed as having a plurality of bowl segments 315, in which the bowl segments 315 may be movable with respect to the main bowl 303. The movable bowl 313 may have a bore 317 defined therein, such as by having the bore 317 segmented across the bowl segments 315, in which the bore 317 may be formed about the axis 300 extending (longitudinally) through the apparatus 301. As such, the main bowl 303 and the movable bowl 313 may have substantially the same axis (e.g., axis 300 of the apparatus 301) such that these axes may align with each other, even when the main bowl 303 and the movable bowl 313 move with respect to each other.

The movable bowl 313 may be formed such that a top opening 319 of the bore 317 is formed at a top side of the movable bowl 313, and a bottom opening of the bore 317 is formed at a bottom side of the movable bowl 313. Further, the illustrated movable bowl 313 may have an inner surface 321 that extends between the top opening 319 to the bottom opening of the movable bowl 313. As shown in FIGS. 3A, 3B, 4A, 4B, 5A, and 5B, as the movable bowl 313 may be formed as the plurality of bowl segments 315 in this embodiment, the inner surface 321 of the movable bowl 313 may be formed and/or defined as the inner surface 321 of the plurality of bowl segments 315.

Similar to the main bowl 303, the inner surface 321 of the movable bowl 313 may be tapered with respect to the axis 300, such as by having the inner surface 321 skewed at an angle with respect to the axis 300. For example, movable bowl 313 may have a smooth, non-stepped profile, tapered inner surface 321, or at least a portion of the inner surface 321 of the movable bowl 313 may have a smooth, non-stepped, tapered profile. As such, the movable bowl 313 may be used to enable the apparatus 301 to engage a range of tubular members having different dimensions included and received within the movable bowl 313. However, those having ordinary skill in the art will appreciate that the present disclosure is not so limited, as other shapes and profiles, such as a stepped (e.g., rapid advance) profile, may be used for the inner surface of the movable bowl without departing from the scope of the present disclosure.

The plurality of bowl segments 315 may be movable with respect to the main bowl 303 (e.g., in-and-out of the main bowl 303), such as by having the bowl segments 315 movably received within the main bowl 303 and/or movably connected to the main bowl 303. Specifically, the bowl segments 315 may be movable in a radial direction with respect to the main bowl 303 (e.g., towards and/or away from the axis 300), and/or the bowl segments 315 may be movable in a longitudinal direction with respect to the main bowl 303 (e.g., along the axis 300). For example, by having the bowl segments 315 movably received and/or movably connected to the main bowl 303, the bowl segments 315 may be able to "slide" towards and/or away from the axis 300, e.g., move along the inner surface 311 of the main bowl 303. Further, the bowl segments 315 may be restricted from lateral movement in the bore 305 (e.g., movement about the axis 300), for example, while still allowing for movement towards and/or away from axis 300 (e.g., radial movement relative to axis 300 of the bore 305 of the main bowl 303).

The bowl segments 315 may each have multiple surfaces defined thereon, such as by having the inner surface 321 and an outer surface 323. As shown, the inner surface 321 of the bowl segments 315 is defined as a surface on the bowl segments 315 that is exposed toward the axis 300, and the outer surface 323 of the bowl segments 315 is defined as a surface on the bowl segments 315 that is exposed away from the axis 300 (e.g., toward the inner surface 311 of the main bowl 303). As discussed above, in accordance with one or more embodiments of the present disclosure, one or more of the surfaces of the bowl segments 315 may be tapered with respect to the axis 300. For example, in one or more embodiments, as shown in FIG. 3A, the outer surface 323 of one or more of the bowl segments 315 may be tapered with respect to the axis 300, in which the outer surface 323 may be disposed at substantially the same angle as the tapered inner surface 311 of the main bowl 303. In such embodiments, the tapered outer surface 323 of the bowl segments 315 may be able to engage (e.g., slide along) the tapered inner surface 311 of the main bowl 303.

The depicted apparatus 301 may further include a plurality of slip assemblies 331, in which the slip assemblies 331 may be movable with respect to the main bowl 303 and/or the movable bowl 313 (e.g., in-and-out of the main bowl 303 and/or the movable bowl 313). For example, the slip assemblies 331 may be movably received within the main bowl 303 and/or the movable bowl 313, such as movably connected to the main bowl 303 and/or the movable bowl 313. Specifically, the slip assemblies 331 may be movable in a radial direction with respect to the main bowl 303 and/or the movable bowl 313 (e.g., towards and/or away from the axis 300), and/or the slip assemblies 331 may be movable in a longitudinal direction with respect to the main bowl 303 and/or the movable bowl 313 (e.g., along the axis 300).

For example, by having the slip assemblies 331 movably connected to the movable bowl 313, the slip assemblies 331 may be able to "slide" towards and/or away from the axis 300, e.g., move along the inner surface 321 of the movable bowl 313. As such, the slip assemblies 331 may engage a tubular member included within the apparatus 301, such as engaging an outer surface of a tubular member received within the apparatus 301. Further, the slip assemblies 331 may be restricted from lateral movement in the bore 305 of the main bowl 303 and/or the bore 317 of the movable bowl 313 (e.g., movement about the axis 300), for example, while still allowing for movement towards and/or away from axis 300 (e.g., radial movement relative to axis 300).

The slip assemblies 331 may each have multiple surfaces defined thereon, such as by having an inner surface 333 and an outer surface 335. As shown, the inner surface 333 of the slip assemblies 331 is defined as a surface on the slip assemblies 331 that is exposed toward the axis 300, and the outer surface 335 of the slip assemblies 331 is defined as a surface on the slip assemblies 331 that is exposed away from the axis 300 (e.g., toward the inner surface 321 of the movable bowl 313).

In accordance with one or more embodiments of the present disclosure, one or more of the surfaces of the slip assemblies 331 may be tapered with respect to the axis 300. For example, in one or more embodiments, as shown in FIG. 3A, the outer surface 335 of one or more of the slip assemblies 331 may be tapered with respect to the axis 300, such as disposed at substantially the same angle as the tapered inner surface 321 of the movable bowl 313. In such embodiments, the tapered outer surface 335 of the slip assemblies 331 may be able to engage (e.g., slide along) the tapered inner surface 321 of the movable bowl 313. As such, and as shown in FIGS. 3A, 3B, 4A, 4B, 5A, and 5B, though the present disclosure is not so limited, the number of bowl segments 315 included within the movable bowl 313 may correspond to the number of slip assemblies 331 such that each particular slip assembly 331 may correspond and engage with a particular bowl segment 315.

Figure 8A:
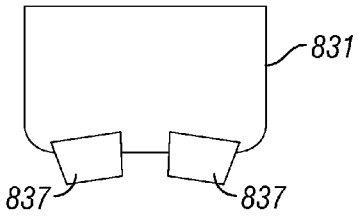
FIGS. 8A and 8B show a slip assembly in accordance with one or more embodiments of the present disclosure.
Figure 9A:
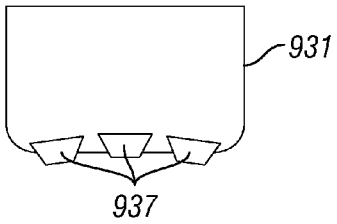
FIGS. 9A and 9B show a slip assembly in accordance with one or more embodiments of the present disclosure.
Figure 8B:
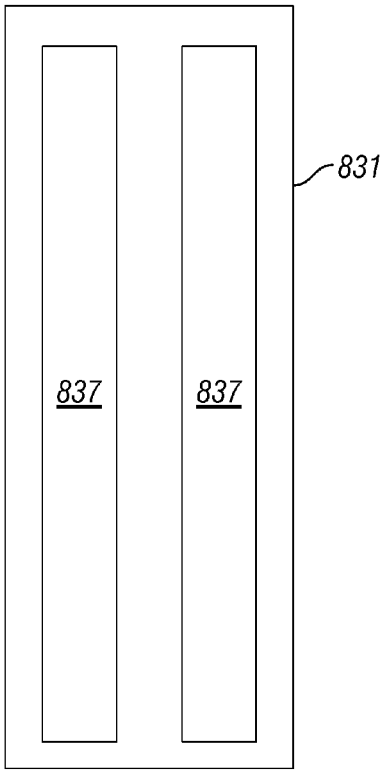
Figure 9B:
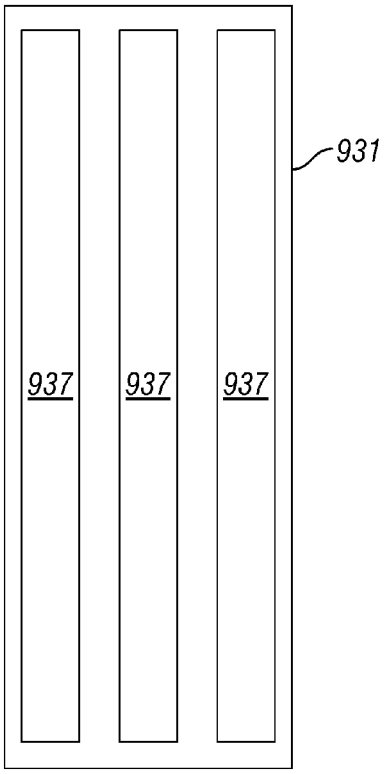

Further, the inner surface 333 of the slip assemblies 331 may include a die column, such as to facilitate engagement of the slip assemblies 331 with the outer surface of a tubular member. For example, the inner surface 333 of the slip assemblies 331 is shown including a single die column 337, in which the die column 337 may be used to grip and "bite" into the outer surface of the tubular member. By including only a single die column 337 on the slip assemblies 331, this arrangement may facilitate the slip assemblies 331 being able to engage and grip the outer surface of tubular members having a range of sizes. Those having ordinary skill in the art will appreciate that the present disclosure is not so limited though, as more than one die column may be included with the slip assemblies without departing from the scope of the present disclosure. For example, with reference to FIGS. 8A and 8B, one or more slip assemblies 831 may include a double die column, in which two die columns 837 may be included on the slip assembly 831. The die columns 837 may be oriented in parallel with each other and/or the die columns 837 may be rotated with respect to each other such that the faces of the die columns 837 may be arranged on an arc to facilitate engagement of the die columns 837 with the cylindrical outer surface of a tubular member. Further, with reference to FIGS. 9A and 9B, one or more slip assemblies 931 may include a triple die column, in which three die columns 937 may be included on the slip assembly 931. The die columns 937 may be oriented in parallel with each other and/or the die columns 937 may be rotated with respect to each other such that the faces of the die columns 937 may be arranged on an arc to facilitate engagement of the die columns 937 with the cylindrical outer surface of a tubular member. As such, the scope of the present disclosure is not limited to only those embodiments shown within the present figures.

As discussed above, the inner surface 311 of the main bowl 303 and/or the inner surface 321 of the movable bowl 313 may be tapered with respect to the axis 300 of the apparatus 301. As such, the inner surface 311 of the main bowl 303 and the inner surface 321 of the movable bowl 313 may be disposed at substantially the same angle of taper with respect to the axis 300 of the apparatus 301. Alternatively, the inner surface 311 of the main bowl 303 may include a larger angle of taper than the inner surface 321 of the movable bowl 313 with respect to the axis 300, and/or the inner surface 311 of the main bowl 303 may include a smaller angle of taper than the inner surface 321 of the movable bowl 313 with respect to the axis 300. Accordingly, the present disclosure contemplates other configurations and embodiments other than those shown in FIGS. 3A, 3B, 4A, 4B, 5A, and 5B without departing from the scope of the present disclosure.

Referring still to FIGS. 3A, 3B, 4A, 4B, 5A, and 5B, the apparatus 301 may include one or more support rings or "timing rings." For example, the apparatus 301 may include a movable bowl timing ring 341 and/or may include a slip assembly timing ring 351. The movable bowl timing ring 341 may be movably connected to the main bowl 303 and/or the movable bowl 313. In particular, the movable bowl timing ring 341 may be connected between the main bowl 303 and the movable bowl 313, in which the movable bowl timing ring 341 may be movable, such as between an upper position and a lower position, with respect to the main bowl 303. For example, the movable bowl timing ring 341 may be able to move in a longitudinal direction (i.e., vertically) along the axis 300.

Further, in an embodiment in which the movable bowl 313 includes the plurality of bowl segments 315, the bowl segments 315 may be movably connected to the movable bowl timing ring 341. As such, the movable bowl timing ring 341 may enable the apparatus 301 to have substantially similar control over the bowl segments 315, such as when the bowl segments 315 are moving in the longitudinal direction along the axis 300 of the apparatus. As shown, a pin-and-link mechanism 343 may be used to enable the bowl segments 315 to move in the radial direction with respect to the axis 300. Additionally or alternatively, the bowl segments 315 may be able to move in the longitudinal direction along the axis 300, such as when the movable bowl timing ring 341 moves in the longitudinal direction along the axis 300. However, those having ordinary skill in the art will appreciate that other mechanisms or connections may be used to movably connect the bowl segments to the movable bowl timing ring and/or the main bowl. For example, in accordance with embodiments disclosed herein, a slide mechanism may be used to movably connect the bowl segments to the movable bowl timing ring. As such, the present disclosure contemplates other structures and/or arrangements for the apparatus without departing from the scope of the present disclosure.

Furthermore, the slip assembly timing ring 351 may be movably connected to the main bowl 303 and/or the movable bowl 313. In particular, the slip assembly timing ring 351 may be connected between the main bowl 303 and the movable bowl 313, in which the slip assembly timing ring 351 may be movable, such as between an upper position and a lower position, with respect to the main bowl 303. For example, the slip assembly timing ring 351 may be able to move in a longitudinal direction (i.e., vertically) along the axis 300.

The plurality of slip assemblies 331 may be movably connected to the slip assembly timing ring 351. As such, the slip assembly timing ring 351 may enable the apparatus 301 to have substantially similar control over the slip assemblies 331, such as when the slip assemblies 331 are moving in the longitudinal direction along the axis 300 of the apparatus. As shown, a pin-and-link mechanism 353 may be used to enable the slip assemblies 331 to move in the radial direction with respect to the axis 300. Additionally or alternatively, the slip assemblies 331 may be able to move in the longitudinal direction along the axis 300, such as when the slip assembly timing ring 351 moves in the longitudinal direction along the axis 300. However, those having ordinary skill in the art will appreciate that other mechanisms or connections may be used to movably connect the slip assemblies to the slip assembly timing ring, the movable bowl, and/or the main bowl. For example, in accordance with embodiments disclosed herein, a slide mechanism may be used to movably connect the slip assemblies to the slip assembly timing ring. As such, the present disclosure contemplates other structures and/or arrangements for the apparatus without departing from the scope of the present disclosure.

In accordance with one or more embodiments of the present disclosure, to have the movable bowl timing ring 341 movably connected to the main bowl 303, the apparatus 301 may include a plurality of guide cylinders 345. The guide cylinders 345 may be connected between the movable bowl timing ring 341 and the main bowl 303, in which the guide cylinders 345 may be movable, such as between an upper position and a lower position, with respect to the main bowl 303. As shown, the guide cylinders 345 may extend from the main bowl 303, such as from the top side 307 of the main bowl 303, in which the guide cylinders 345 may be substantially parallel with the axis 300. As such, in one or more embodiments, the movable bowl timing ring 341 may be attached to the top end of the guide cylinders 345, in which the guide cylinders 345 may be able to move in the longitudinal direction along the axis 300. The movement of the guide cylinders 345 may enable the movement of the movable bowl timing ring 341.

Further, in accordance with one or more embodiments of the present disclosure, to have the slip assembly timing ring 351 movably connected to the main bowl 303 and/or the movable bowl 313, the apparatus 301 may include a plurality of guide rods 355. The guide rods 355 may be connected between the slip assembly timing ring 351 and the main bowl 303, in which the guide rods 355 may be movable, such as between an upper position and a lower position, with respect to the main bowl 303. As shown, the guide rods 355 may extend from the main bowl 303, such as from the top side 307 of the main bowl 303, in which the guide rods 355 may be substantially parallel with the axis 300. As such, in one or more embodiments, the slip assembly timing ring 351 may be attached to the top end of the guide rods 355, in which the guide rods 355 may be able to move in the longitudinal direction along the axis 300. The movement of the guide rods 355 may enable the movement of the slip assembly timing ring 351.

As shown in FIGS. 3A, 3B, 4A, 4B, 5A, and 5B, in an embodiment in which the apparatus 301 includes the plurality of guide cylinders 345 and the plurality of guide rods 355, one or more of the guide rods 355 may be movably received within one or more of the guide cylinders 345. For example, the guide rods 355 may be able to move with respect to and within the guide cylinders 345. This arrangement may enable the slip assembly timing ring 351 connected to the guide rods 355 to be able to move with respect to the movable bowl timing ring 341 connected to the guide cylinders 345. As such, in one or more embodiments, though the present disclosure is not so limited, each of the guide rods 355 may correspond to each of the guide cylinders 345.

Referring still to FIGS. 3A, 3B, 4A, 4B, 5A, and 5B, and in addition or in alternative to the plurality of guide cylinders 345 and/or the plurality of guide rods 355, the apparatus 301 may include a plurality of actuator rods 361. The actuator rods 361 are shown connected between the slip assembly timing ring 351 and the main bowl 303, but, in accordance with one or more embodiments of the present disclosure, the actuator rods 361 may be connected between the movable bowl timing ring 341, the slip assembly timing ring 351, and/or the main bowl 303. The actuator rods 361 may be movable, such as between an upper position and a lower position, with respect to the main bowl 303. As shown, the actuator rods 361 may extend from the main bowl 303, such as from the top side 307 of the main bowl 303, in which the actuator rods 361 may be substantially parallel with the axis 300. As such, in the shown embodiment, the slip assembly timing ring 351 may be attached to the top end of the actuator rods 361, in which the actuator rods 361 may be able to move in the longitudinal direction along the axis 300. Further, the movement of the actuator rods 361 may enable the movement of the movable bowl timing ring 341 and/or the slip assembly timing ring 351.

In some embodiments, as the guide cylinders 345, the guide rods 355, and/or the actuator rods 361 may move in the longitudinal direction along the axis 300, the guide cylinders 345, the guide rods 355, and/or the actuator rods 361 may extend into and out of one or more cavities formed within the main bowl 303. These cavities may be able to retain the guide cylinders 345, the guide rods 355, and/or the actuator rods 361 within the main bowl 303 after the guide cylinders 345, the guide rods 355, and/or the actuator rods 361 have moved longitudinally downward along the axis 300, such as moved into the lower position. Furthermore, in selected embodiments, the movable bowl timing ring 341 and/or the slip assembly timing ring 351 may be powered mechanically, hydraulically, pneumatically, and/or electrically.

In selected embodiments, when using hydraulic power, fluids may be pumped into and/or out of the cavities to move one or more of the guide cylinders 345, the guide rods 355, and/or the actuator rods 361 downward and/or upward, and therefore also moving the movable bowl timing ring 341 and/or the slip assembly timing ring 351 connected thereto downward and/or upward. Further, in selected embodiments, when using mechanical power, one or more of the guide cylinders 345, the guide rods 355, and/or the actuator rods 361, such as the actuator rods 361 shown in FIGS. 3A, 3B, 4A, 4B, 5A, and 5B, may be screw jacks to move one or more of the guide cylinders 345, the guide rods 355, and/or the actuator rods 361 downward and/or upward, and therefore also moving the movable bowl timing ring 341 and/or the slip assembly timing ring 351 connected thereto downward and/or upward.

In one or more embodiments of the apparatus 301 including the movable bowl timing ring 341 and the slip assembly timing ring 351, the movable bowl timing ring 341 may be biased away from the slip assembly timing ring 351. In particular, with respect to FIGS. 3A, 3B, 4A, 4B, 5A, and 5B, the movable bowl timing ring 341 may be biased downwards longitudinally along the axis 300 with the slip assembly timing ring 351 biased upwards longitudinally along the axis 300. For example, one or more biasing mechanisms, such as a spring, may be disposed between the movable bowl timing ring 341 and the slip assembly timing ring 351 to bias the movable bowl timing ring 341 away from the slip assembly timing ring 351. In such an embodiment, a spring may be disposed about one or more of the plurality of guide rods 355 in between the movable bowl timing ring 341 and the slip assembly timing ring 351, in which the spring may bias the movable bowl timing ring 341 downwards longitudinally along the axis 300 and may bias the slip assembly timing ring 351 upwards longitudinally along the axis 300. Those having ordinary skill in the art, however, will appreciate that other embodiments, arrangements, and configurations may be used in accordance with the present disclosure, such as by including one or more biasing mechanisms within the plurality of guide cylinders and/or within the main bowl to bias the movable bowl timing ring away from the slip assembly timing ring, without departing from the present disclosure.

By including the movable bowl timing ring 341 and the slip assembly timing ring 351, the movement of the components within the apparatus 301 may be synchronized with respect to each other. Further, by biasing the movable bowl timing ring 341 and the slip assembly timing ring 351 away from each other, the movable bowl timing ring 341 and the slip assembly timing ring 351 may remain separated from each other until contact with the outer surface of a tubular member is achieved. For example, when in use and moving between an upper position and a lower position, such as when moving between a disengaged position to an engaged position, the movable bowl timing ring 341 and the slip assembly timing ring 351 may maintain a separation therebetween. As such, when moving downward, the movable bowl timing ring 341 may be lowered until the movable bowl timing ring 341 contacts the main bowl 303, thereby preventing any further movement, or the plurality of bowl segments 315 connected to the movable bowl timing ring 341 contact an outer surface of a tubular member within the apparatus 301.

At this point, the slip assembly timing ring 351 may continue to be lowered with respect to the movable bowl timing ring 341 such that the plurality of slip assemblies 331 connected to the slip assembly timing ring 351 contact and engage the outer surface of the tubular member within the apparatus 301. This movement may enable the slip assemblies 331 to achieve a preload engagement and bite within the outer surface of the tubular member such that the apparatus 301 may support the tubular member. Further, by biasing the movable bowl timing ring 341 and the slip assembly timing ring 351 away from each other, the slip assembly timing ring 351 may be moved, such as through the use of the plurality of actuator rods 361, in which the movable bowl timing ring 341 may follow the movement of the slip assembly timing ring 351 from the biasing force acting thereupon.

Figure 6:
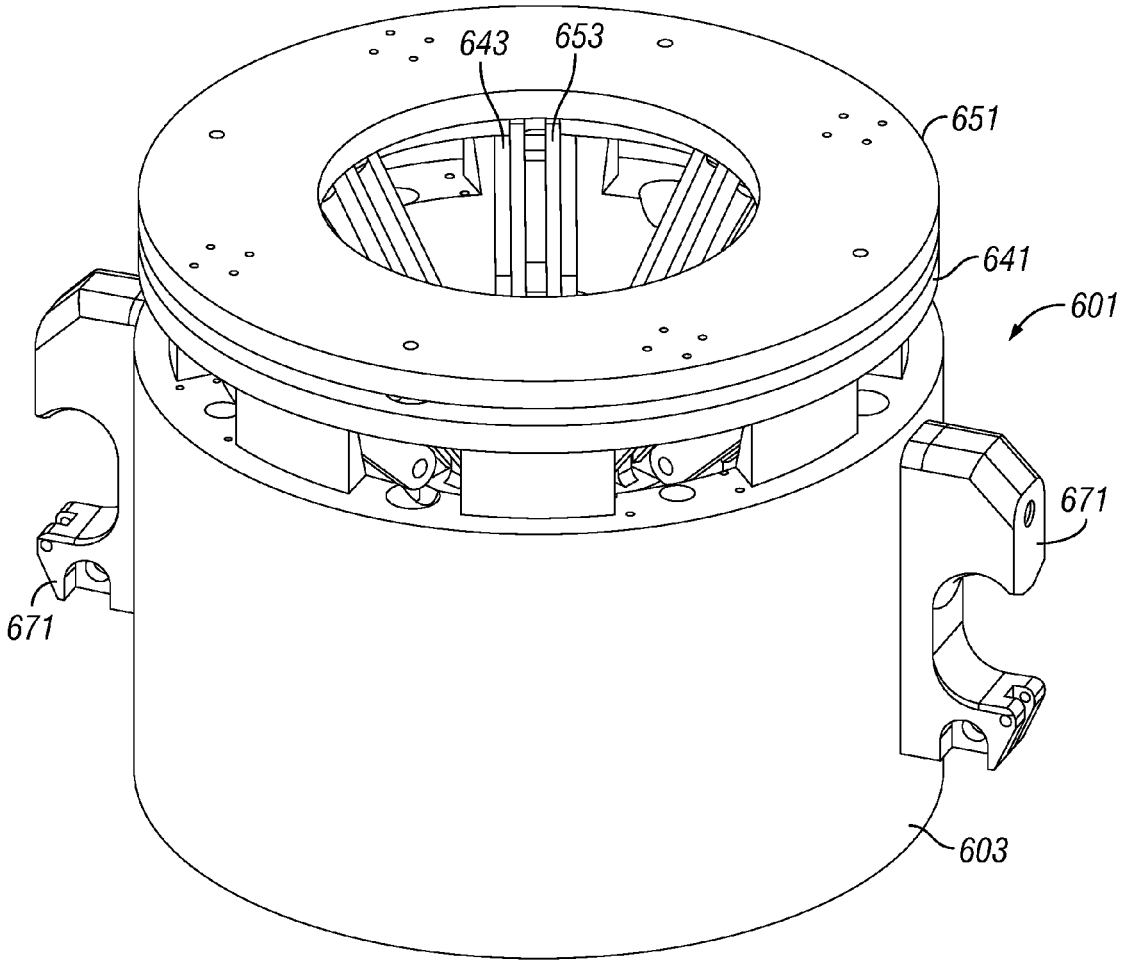
FIG. 6 shows a tubular gripping apparatus in accordance with one or more embodiments of the present disclosure.

Referring now to FIG. 6, a perspective view of an apparatus 601 to engage, grip, and/or support a tubular member in accordance with one or more embodiments of the present disclosure is shown. As with the above, the apparatus 601 may include a main bowl 603. Further, the apparatus 601 may include a movable bowl timing ring 641 and/or may include a slip assembly timing ring 651. As shown, a pin-and-link mechanism 343 may be used to enable bowl segments to move in the radial direction with respect to the axis of the apparatus 601, and a pin-and-link mechanism 353 may be used to enable slip assemblies to move in the radial direction with respect to the axis of the apparatus 601. Further, as discussed above, the apparatus 601 may be used within multiple scenarios within an oil and gas environment, such as may be a lifting apparatus (e.g., 105 in FIG. 1), an elevator, a supporting apparatus (e.g., 107 in FIG. 1), a gripping device (e.g., 201 in FIGS. 2A and 2B) and/or any other device or mechanism used to support a tubular member. As such, the apparatus 601, in one or more embodiments, may include one or more lifting ears 671, in which the lifting ears 671 may be used to enable the apparatus 601 to be suspended therefrom. The lifting ears 671, as shown, may be connected to and/or formed with the apparatus 601, such as positioned on the exterior of the main bowl 601 and/or may be diametrically opposed for stability when suspending the apparatus 601.

Accordingly, by including a main bowl, a movable bowl, and/or a plurality of slip assemblies, a tubular gripping apparatus in accordance with one or more embodiments of the present disclosure may be able to engage, grip, and support tubular members having a variety of shapes, sizes, and/or dimensions. For example, a tubular gripping apparatus in accordance with one or more embodiments of the present disclosure may be able to engage, grip, and support tubular members having an outer diameter ranging between about 7 inches (about 18 cm) to about 20 inches (about 51 cm), such as a tubular member having an outer diameter of about 8.5 inches (about 21.6 cm), without the need to change any components of the tubular gripping apparatus.

Figure 7:
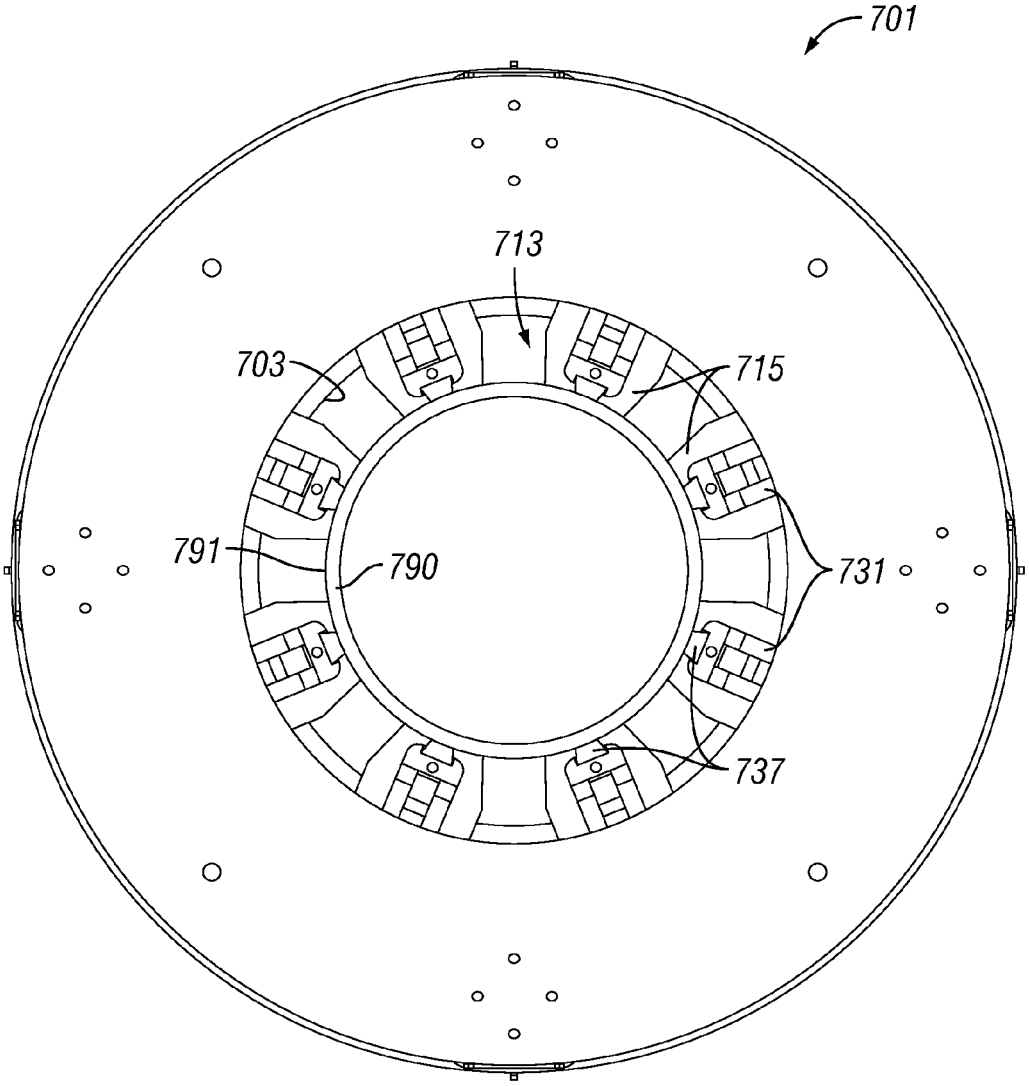
FIG. 7 shows a tubular gripping apparatus supporting a tubular member in accordance with one or more embodiments of the present disclosure.

In accordance with one or more embodiments of the present disclosure, a tubular gripping apparatus may be able to adjust (e.g., self-adjust) for use with tubular members having multiple sizes. For example, with reference to FIG. 7, in one or more embodiments, such as for a tubular member 790 having an outer diameter ranging between about 8.5 inches (about 21.6 cm) to about 20 inches (about 51 cm), a movable bowl 713 may move downward and/or radially inward with respect to a main bowl 703 until the movable bowl 713 and/or one or more bowl segments 715 of the movable bowl 713 contact an outer surface 791 of the tubular member 790 positioned within a tubular gripping apparatus 701. Upon or after the movable bowl 713 and/or the bowl segments 715 of the movable bowl 713 contact the outer surface 791 of the tubular member 790, one or more of a plurality of slip assemblies 731 may move downward and/or radially inward with respect to the main bowl 703 and/or movable bowl 713 such that the plurality of slip assemblies 731 contact, engage, and/or grip (e.g., bite into) the outer surface 791 of the tubular member 790. In particular, the slip assemblies 731 may each include one or more die columns 737, in which the die column 737 may be used to grip and "bite" into the outer surface 790 of the tubular member 791. This movement may enable the tubular gripping apparatus 701 to adjust to and support the tubular member 790.

Further, for a tubular member, such as having an outer diameter ranging between about 7 inches (about 18 cm) to about 8.5 inches (about 21.6 cm), a movable bowl may move downward and/or radially inward with respect to a main bowl until the movable bowl and/or bowl segments of the movable bowl contact the main bowl of the tubular gripping apparatus. After the movable bowl and/or bowl segments of the movable bowl contact the main bowl, a plurality of slip assemblies may move downward and/or radially inward with respect to the main bowl and/or movable bowl such that the plurality of slip assemblies contact, engage, and/or grip the outer surface of the tubular member such that the tubular gripping apparatus may support the tubular member. Accordingly, though one having ordinary skill in the art will appreciate that the present disclosure is not limited to the above examples and dimensions, by including a main bowl, a movable bowl, and/or a plurality of slip assemblies, a tubular gripping apparatus in accordance with one or more embodiments of the present disclosure may be able to engage, grip, and support tubular members having a variety of shapes, sizes, and/or dimensions.

Although the present invention has been described with respect to specific details, it is not intended that such details should be regarded as limitations on the scope of the invention, except to the extent that they are included in the accompanying claims.

What is claimed is:

1. An apparatus to grip a tubular member, comprising:

a main bowl including a bore formed therethrough about an axis;

a movable bowl movably receivable within the main bowl, the movable bowl including a bore formed therethrough about an axis with a tapered surface extending along the bore of the movable bowl;

a plurality of slip assemblies movably receivable within the movable bowl, the plurality of slip assemblies configured to engage an outer surface of the tubular member;

a movable bowl timing ring connected between the main bowl and the movable bowl, the movable bowl timing ring movable with respect to the main bowl; and a slip assembly timing ring connected between the plurality of slip assemblies and one of the main bowl or the movable bowl, the slip assembly timing ring movable with respect to the one of the main bowl or the movable bowl.

2. The apparatus of claim 1, wherein:

the movable bowl is movably receivable within the main bowl such that the axis of the main bowl substantially aligns with the axis of the movable bowl; and the plurality of slip assemblies are movable along the tapered surface of the movable bowl.

3. The apparatus of claim 2, wherein:

the main bowl comprises a tapered surface extending along the bore of the main bowl; and the movable bowl comprises a plurality of bowl segments movable along the tapered surface of the main bowl.

4. The apparatus of claim 3, wherein each of the plurality of slip assemblies corresponds to each of the plurality of bowl segments.

5. The apparatus of claim 1, further comprising:

a plurality of guide cylinders connected between the movable bowl timing ring and the main bowl, the plurality of guide cylinders movable with respect to the main bowl; and a plurality of guide rods connected between the slip assembly timing ring and the main bowl, the plurality of guide rods movable with respect to the main bowl.

6. The apparatus of claim 5, wherein each of the plurality of guide rods are movably received within each of the plurality of guide cylinders.

7. The apparatus of claim 1, further comprising:

a biasing mechanism disposed between the movable bowl timing ring and the slip assembly timing ring to bias the movable bowl timing ring away from the slip assembly timing ring;

wherein the movable bowl timing ring is biased away from the slip assembly timing ring.

8. The apparatus of claim 7, further comprising:

lifting ears positioned to support the apparatus therefrom.

9. The apparatus of claim 1, further comprising:

a plurality of actuator rods connected between the slip assembly timing ring and the main bowl, the plurality of actuator rods movable with respect to the main bowl.

10. The apparatus of claim 1, wherein at least one of the movable bowl timing ring and the slip assembly timing ring is configured to be actuated using one of mechanical power, pneumatic power, hydraulic power, and electrical power.

11. The apparatus of claim 1, wherein each of the plurality of slip assemblies comprises at least one die column configured to grip the outer surface of the tubular member.

12. The apparatus of claim 1, wherein at least one of the plurality of slip assemblies comprises one of a double die column and a triple die column configured to grip the outer surface of the tubular member.

13. The apparatus of claim 1, wherein the apparatus adjusts to the size of the tubular member such that the movable bowl is configured to contact the outer surface of the tubular member before the plurality of slip assemblies.

14. A method to engage a tubular member with an apparatus, the method comprising:

receiving the tubular member within a bore of a main bowl of the apparatus;

engaging an inner surface of the main bowl with an outer surface of a movable bowl, the movable bowl movable with respect to the main bowl by means of a movable bowl timing ring and the inner surface of the main bowl being tapered and extending along the bore of the main bowl such that the outer surface of the movable bowl engages and moves along the inner tapered surface of the main bowl;

engaging an inner surface of the movable bowl with an outer surface of a plurality of slip assemblies, the plurality of slip assemblies movable with respect to the movable bowl by means of a slip assembly timing ring and the inner surface of the movable bowl being tapered such that the outer surface of the plurality of slip assemblies engages and moves along the inner tapered surface of the movable bowl; and engaging an outer surface of the tubular member with the plurality of slip assemblies.

15. The method of claim 14, wherein:

the movable bowl comprises a plurality of bowl segments movable along the inner surface of the main bowl; and each of the plurality of slip assemblies corresponds to each of the plurality of bowl segments.

16. The method of claim 14, wherein:

engaging the inner surface of the main bowl comprises moving the movable bowl timing ring with respect to the main bowl, the movable bowl timing ring connected between the main bowl and the movable bowl; and engaging the inner surface of the movable bowl comprises moving the slip assembly timing ring with respect to one of the main bowl or the movable bowl, the slip assembly timing ring connected between the plurality of slip assemblies and the one of the main bowl or the movable bowl.

17. The method of claim 16, wherein the movable bowl timing ring is biased away from the slip assembly timing ring.

18. The method of claim 14, wherein the apparatus adjusts to the size of the tubular member such that the engaging the outer surface of the tubular member comprises:

engaging the outer surface of the tubular member with the inner surface of the movable bowl; and engaging the outer surface of the tubular member with the plurality of slips assemblies after engaging the outer surface of the tubular member with the movable bowl.

19. An apparatus to grip a tubular member, comprising:

a main bowl including a bore formed therethrough with a tapered surface extending along the bore of the main bowl;

a movable bowl comprising a plurality of bowl segments connected to the main bowl and movable along the tapered surface of the main bowl between an engaged position and a disengaged position, each of the plurality of bowl segments comprising a tapered surface;

a plurality of slip assemblies connected to the movable bowl, each of the plurality of slip assemblies corresponding to each of the plurality of bowl segments and movable along the tapered surfaces of the plurality of bowl segments between an engaged position and a disengaged position, the plurality of slip assemblies configured to engage an outer surface of a tubular member;

a movable bowl timing ring connected between the main bowl and the movable bowl, the movable bowl timing ring movable with respect to the main bowl; and a slip assembly timing ring connected between the plurality of slip assemblies and one of the main bowl or the movable bowl, the slip assembly timing ring movable with respect to the one of the main bowl or the movable bowl.

20. The apparatus of claim 19, further comprising:

the movable bowl timing ring connected between the main bowl and the movable bowl with a plurality of guide cylinders, the plurality of bowl segments each connected to the movable bowl timing ring, the plurality of guide cylinders movable with respect to the main bowl; and the slip assembly timing ring connected between the plurality of slip assemblies and the main bowl with a plurality of guide rods, the plurality of slip assemblies each connected to the slip assembly timing ring, the plurality of guide rods movable with respect to the main bowl;

wherein each of the plurality of guide rods are movably received within each of the plurality of guide cylinders.

21. The apparatus of claim 20, further comprising:

a biasing mechanism disposed about one of the plurality of guide rods between the movable bowl timing ring and the slip assembly timing ring to bias the movable bowl timing ring away from the plurality of slip assemblies timing ring.

22. The apparatus of claim 20, further comprising:

a plurality of actuator rods connected between the slip assembly timing ring and the main bowl, the plurality of actuator rods movable with respect to the main bowl;

wherein the plurality of actuator rods are configured to be actuated using one of mechanical power, pneumatic power, hydraulic power, and electrical power.

* * * * *